United States Patent [19]

Sakakibara

[11] Patent Number: 5,052,316

[45] Date of Patent: Oct. 1, 1991

[54] FABRIC HOLDING FRAME FOR A SEWING MACHINE

[75] Inventor: Hisato Sakakibara, Inazawa, Japan

[73] Assignee: Kabushikikaisha Barudan, Aichi, Japan

[21] Appl. No.: 638,842

[22] Filed: Jan. 8, 1991

[30] Foreign Application Priority Data

Nov. 1, 1990 [JP] Japan ..... 2-296786

[51] Int. Cl.[5] ..... D05B 21/00; D05B 13/00; D05B 3/12; D05B 25/00

[52] U.S. Cl. ..... 112/121.15; 112/10; 112/104; 112/155

[58] Field of Search ..... 112/121.15, 121.12, 112/103, 104, 10, 155, 121.27, 63, 11, 262.1, 262.2, 265.1

[56] References Cited

U.S. PATENT DOCUMENTS

| | | | |
|---|---|---|---|
| 3,960,096 | 6/1976 | Zobel | 112/265.1 X |
| 4,208,975 | 6/1980 | Teetz | 112/103 X |
| 4,635,574 | 1/1987 | Fujita et al. | 112/121.12 |
| 4,998,964 | 3/1991 | Golia | 112/103 X |

FOREIGN PATENT DOCUMENTS

| | | | |
|---|---|---|---|
| 0219557 | 1/1990 | Japan | 112/103 |

*Primary Examiner*—Peter Nerbun

*Attorney, Agent, or Firm*—Pollock, Vande Sande & Priddy

[57] ABSTRACT

A fabric holding frame consists of a bed plate and a presser frame connected to the bed plate for vertical movement relative to it. The bed plate is provided with a positioner to locate a fabric and plural windows. The presser frame is provided with strap holders at positions where the strap holders face the respective windows. The fabric is put and located on the bed plate and the presser frame is lowered to fix the fabric. The both end portions of plural straps are loaded into the respective plural strap holders. Thus the both end portions of every strap become located at prescribed sewing positions on the fabric. When the bed plate is horizontally moved on a table of a multi-head sewing machine and the sewing machine is operated, the end portions of the straps are sewn on the fabric through the windows of the bed plate.

5 Claims, 9 Drawing Sheets

FABRIC HOLDING FRAME FOR A SEWING MACHINE

BACKGROUND OF THE INVENTION

1. Field of the Invention

This invention relates to a tool which can be used, for example, in manufacturing intermediate bulk containers for the work to unload corns. It relates more particularly to that fabric holding frame for a sewing machine which can be used when the end portions of respective plural straps are sewn, with a sewing machine, on a body fabric to be shaped into a bag main body of the intermediate bulk container.

2. Description of the Prior Art

An example of the intermediate bulk container is shown in FIG. 15 by a reference numeral 80. In this figure, a bag main body 81 is made of fabric and is shaped into a tubular cylinder with a hanging closed bottom portion. Respective straps B are attached at each of the four corners of the upper portion of the bag main body 81. The intermediate bulk containers of this type are manufactured in the following manner. First, each of the end portions Ba of the four straps B are sewn, with the sewing machine, on a flat fabric A before being shaped into the bag main body 81, as shown in FIG. 16. After the straps B have been completely sewn the fabric A is sewn together into the bag main body 81. Thus the intermediate bulk container 80 is completed.

The above mentioned work to sew the end portions Ba of the plural straps B on the fabric A is formerly performed in the following manner. Namely, as shown in FIG. 17A, a sewing worker attaches one end portion Ba of one strap B to one prescribed sewing position P1 on the fabric A. The worker then sews the end portion Ba, with the sewing machine, on the fabric A, keeping the end portion attached to the fabric. Next, the worker twists the intermediate portion of the strap B and attaches the other end portion Ba to the next sewing position P2 on the fabric A. The worker then sews the other end portion, with the sewing machine, on the fabric, keeping the other end portion attached to the fabric. Every one and the other end portions Ba of all the straps B for one intermediate bulk container are repeatedly sewn one after another and an arrangement as shown in FIG. 16 is obtained.

According to this conventional method, the above mentioned sewing work must be performed two times for one end and the other end portions Ba of one strap B. Moreover, such sewing work must be done for each of the straps of one intermediate bulk container. Such work takes a very long time.

Furthermore, according to the above mentioned conventional method, the worker must select either twisting the strap Ba to the right or that to the left according to whether he will twist the strap B in the direction shown by an arrow 90, attaching the other end portion Ba to the sewing position P2 or twist the strap in the direction shown by an arrow 91, attaching the other end portion Ba to a sewing position P3. A case, however, occurs frequently where one of the twistings to the right and to the left is mistaken for the other. In this case, the sewing worker attaches the end portion Ba to the fabric and pays the most attention to sewing the attached end portion while holding firmly the attached end portion. Consequently, it is hard for the worker to become aware of the mistake. As a result, the above mentioned mistake is found only at the time of product inspection after all the straps B have been sewn. Thus the repair of the portions sewn by mistake takes much time.

Furthermore, since the end portions Ba of the straps B are sewn on the fabric A manually by the sewing worker, the end portions Ba are positioned and directed on the fabric A only with low accuracy. Therefore, when the respective straps are sewn on many fabrics, obtained products diverge in qualities.

SUMMARY OF THE INVENTION

The present invention has been done in order to solve the above mentioned technical problems (technical subjects).

A first object of the present invention is to provide that fabric holding frame for a sewing machine with which one and the other end portions of plural straps can be sewn on a fabric, all at one time, with high work efficiency.

Namely, with the fabric holding frame of the present invention, the fabric can be held and every one and the other end portions of the plural straps can be located at respective prescribed sewing positions on the fabric and be maintained there. Accordingly, when a multi-head sewing machine is operated with the fabric and the straps as they are, the above mentioned end portions can be sewn on the fabric at one time while they are kept located relative to the fabric. Namely, the sewing work can be done with very high work efficiency.

A second object of the present invention is to provide that fabric holding frame with which the detection of the mistake in selecting the twistings in the two directions and the correction of the mistake can be performed very easily when the plural straps are sewn in the above mentioned manner.

Namely, with the fabric holding frame of the present invention, when the fabric and the plural straps are loaded, the relationship of the plural straps relative to the fabric is the same as that which results when the straps have been sewn. Namely, such temporal setting of the straps that is the same as the setting of the sewn straps is already prepared before the sewing work. Accordingly, the worker can inspect, at an early time before the sewing work, whether there is any mistake in selecting the twisting direction to the right or to the left by watching the state of the temporarily set plural straps (the state of FIG. 1).

Moreover in this case, the plural straps are held to be kept located at the prescribed positions. In this state of the straps, the worker need no longer pay much attention to maintaining the state of the straps located relative the fabric. Namely, the worker has completed the first stage. Accordingly, the worker can watch the state of the fabric and the plural straps in a more relaxed manner. Therefore the worker can perform the above mentioned inspection reliably and easily. When the worker detects a mistake he can remove the end portion of the mistaken strap, which is not yet sewn together, and correct immediately the mistake.

A third object of the present invention is to provide that fabric holding frame with which homogeneous products with straps attached to respective exact positions can be offered when the respective plural straps are sewn on many fabrics.

Namely, with the fabric holding frame of the present invention, the both end portions of the plural straps are mechanically positioned by strap holders. Accordingly, the positional relationship of the plural straps relative to the fabric is always constant when the respective plural straps are sewn on many fabrics. As a result, homogeneous products can be offered.

Another object of the present invention is to provide that fabric holding frame for a sewing machine with which the above mentioned work to sew the straps can be performed for many fabrics one after another with high work efficiency and improved productivity.

Namely, when two strap holders are arranged, according to the present invention, in parallel side by side at one place and are adapted to be located at a needle drop position, the straps for the next fabric can be loaded in one of the strap holders while the straps loaded in the other strap holder are being sewn on one fabric. This means that it can be made needless to take an independent time for loading the straps. As a result, the number of fabrics on which the straps can be sewn per unit time can be increased and productivity is improved.

Other objects and advantages of the invention will become apparent during the following discussion of the accompanying drawings.

DESCRIPTION OF THE PREFERRED EMBODIMENTS

Figure 1:
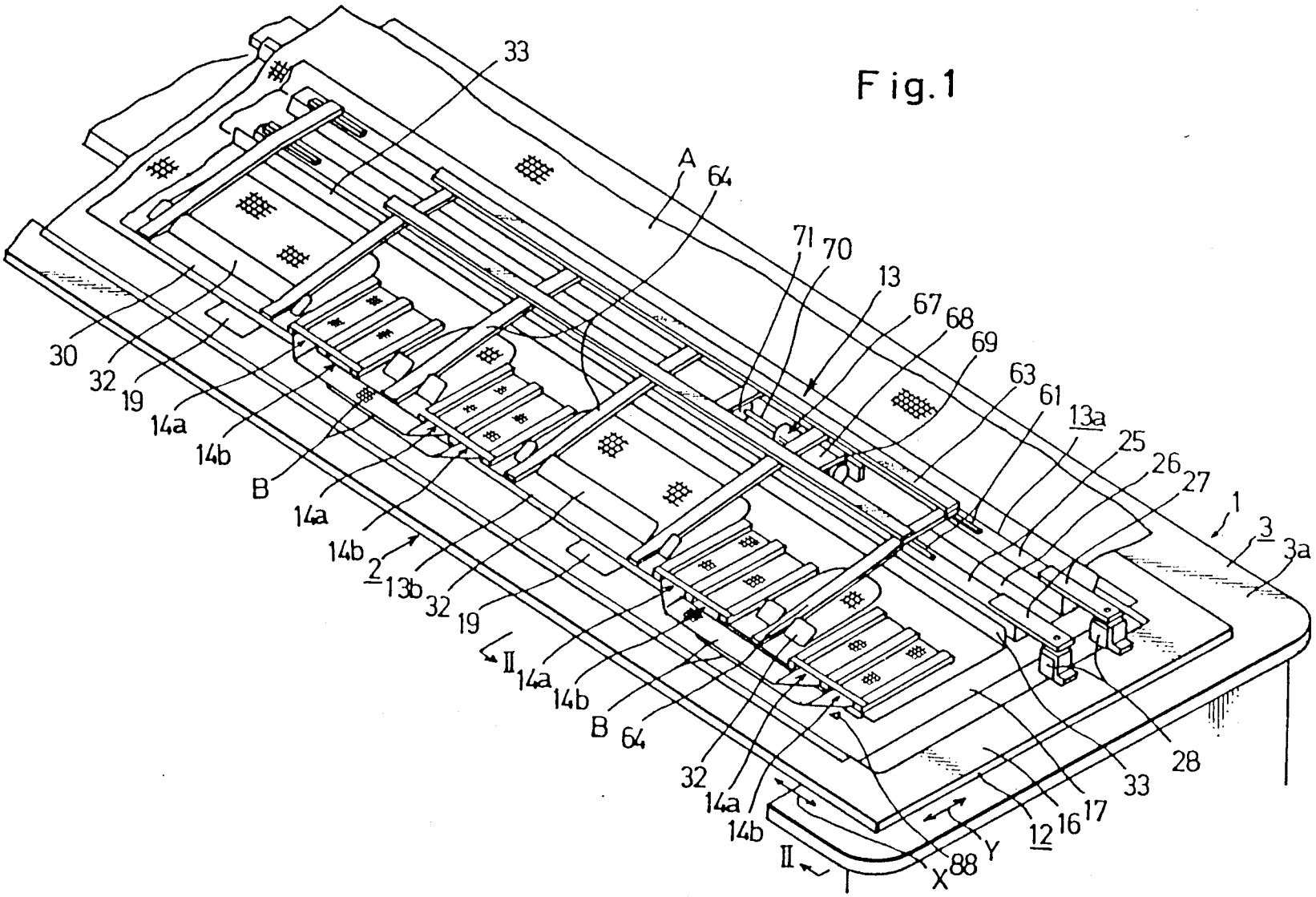
FIG. 1 is a perspective view showing the state of a fabric holding frame in use (the illustration of a sewing head being omitted)
Figure 2:
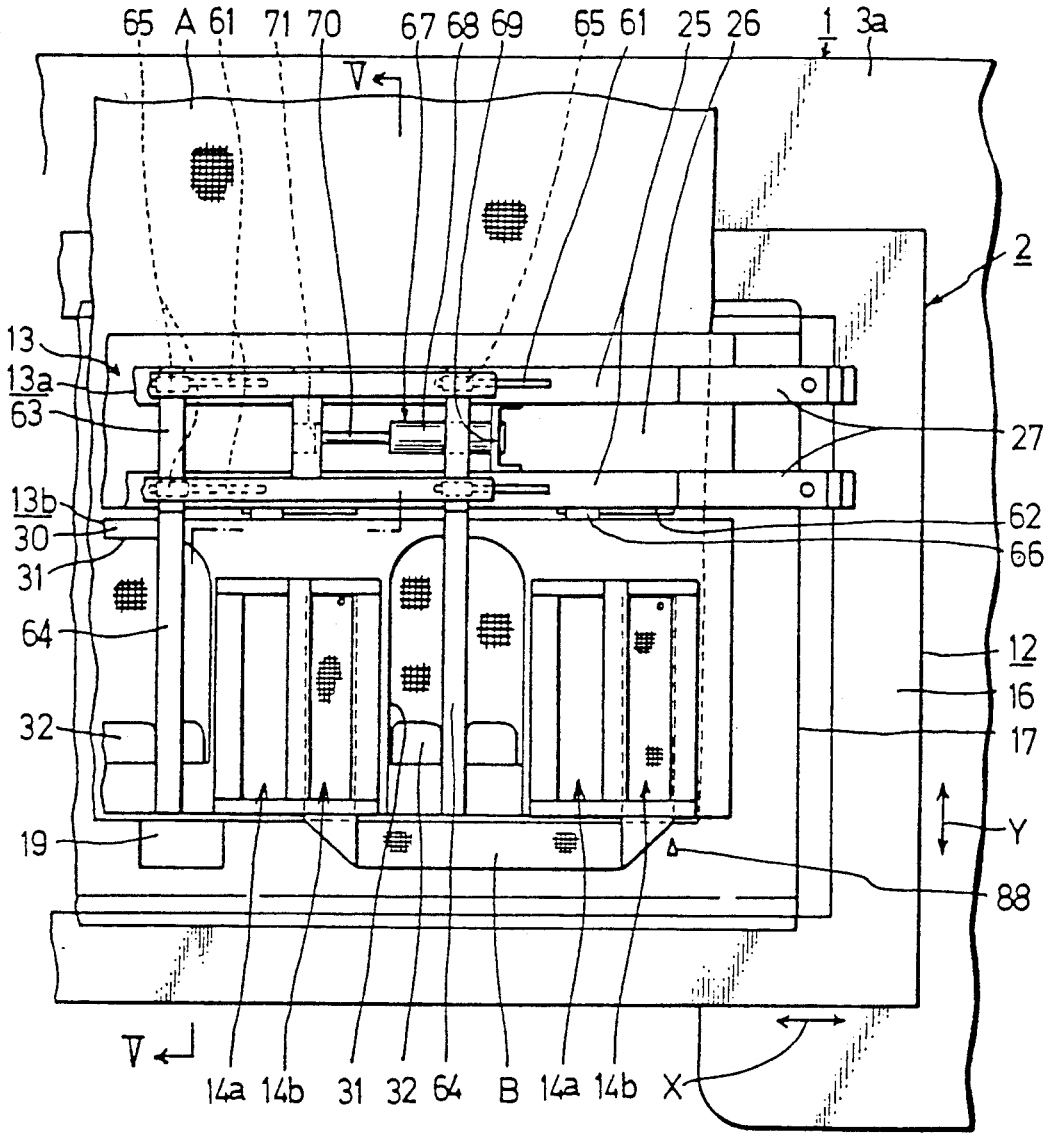
FIG. 2 is a plane view of a section of II—II in FIG. 1 (only one strap being shown)
Figure 4:
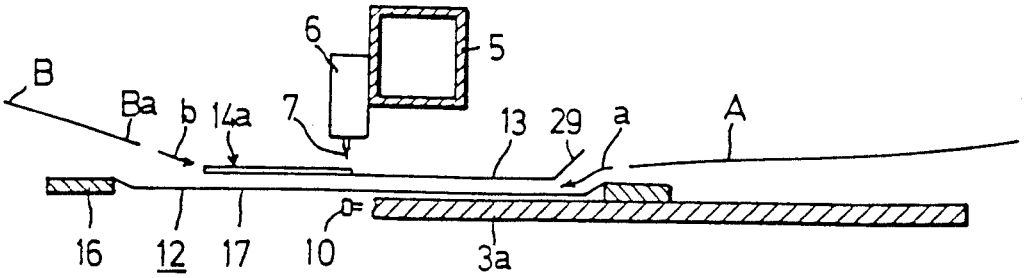
FIG. 4 is a longitudinal schematic section showing the directions of the introduction of the fabric and the insertion of the straps (a machine frame and the sewing head being shown as well)
Figure 3:
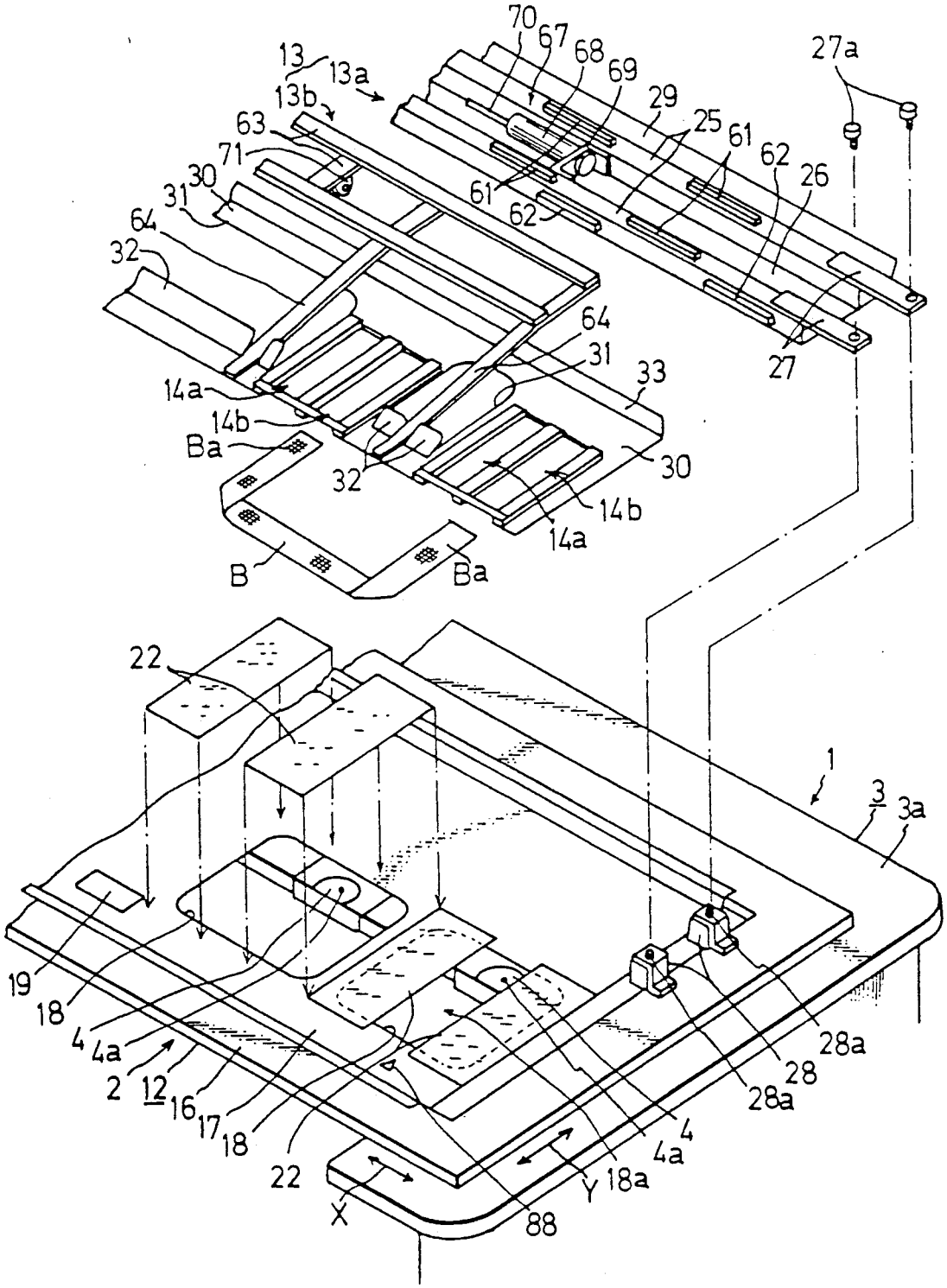
FIG. 3 is a fragmentary perspective view of the fabric holding frame.
Figure 9:
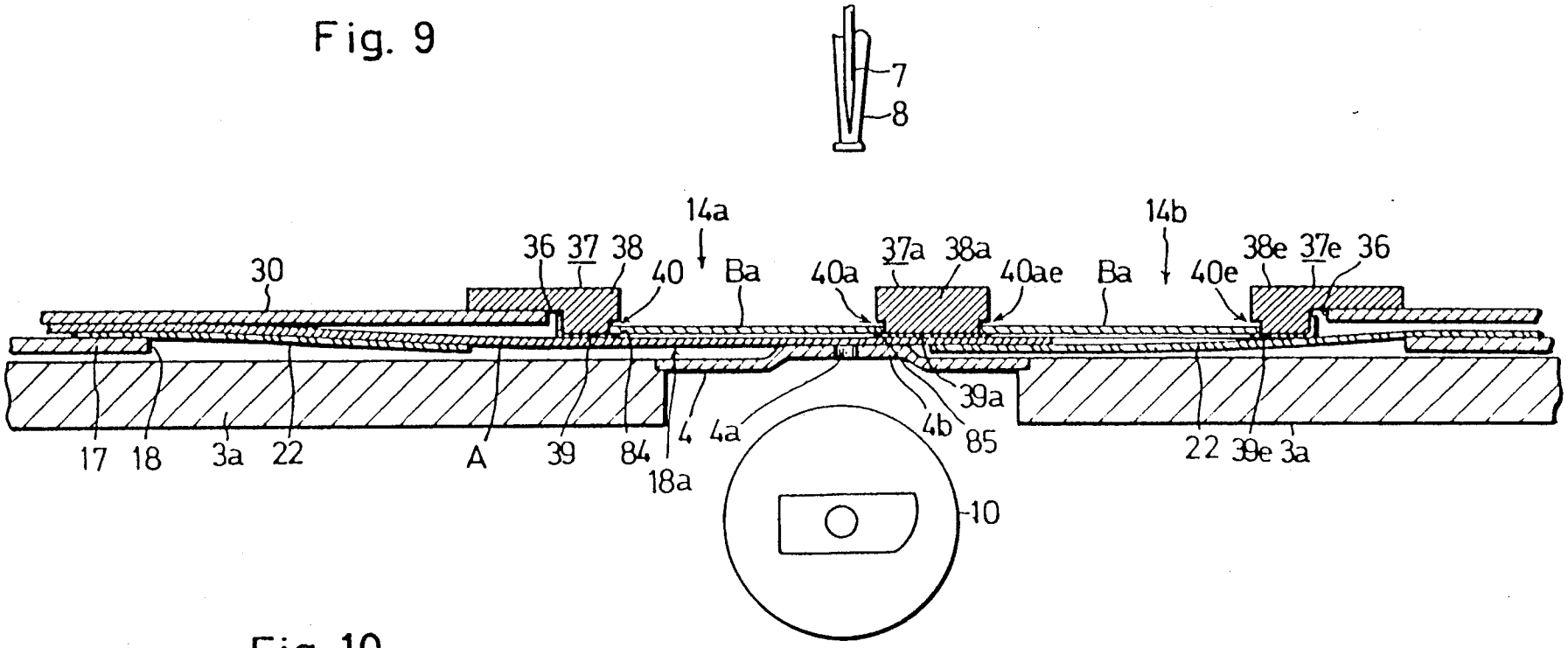
FIG. 9 is a section taken along a line IX—IX in FIG. 7, with the straps loaded.

In FIGS. 1 through 3, numerals 1 and 2 show a multi-head sewing machine and a fabric holding frame used in the sewing machine, respectively. The multi-head sewing machine 1 has a table 3. Plural throat plates 4 provided with respective needle holes 4*a* are mounted on a top plate 3*a* of the table 3. The needle hole 4*a* of each throat plate 4 is adapted to coincide with the needle drop point of the multi-head sewing machine, i.e. the point where a sewing needle to be described hereinafter descends. Such number of the above mentioned throat plates as corresponds to the number of the end portions of straps to be attached on one fabric are prepared. In the case of the present embodiment, 8 throat plates are provided, since the number of all the straps is 4 and so the number of the end portions is 8. In the figure, only some of the throat plates are shown. When the number of the straps to be attached is a different one, for example, 2, then the number of the throat plates is twice the number of the straps, i.e. 4. The spacing among these throat plates are adapted to coincide with the corresponding spacings among the prescribed sewing positions for the end portions of the plural straps. A machine frame 5 with both ends thereof secured on a frame of the sewing machine is provided horizontally over the top plate 3*a* as shown in FIG. 4. Respective sewing heads 6 are mounted on the machine frame 5 over the throat plates 4. The sewing head 6 has a sewing needle 7 and a presser foot 8 as shown in FIG. 9. A rotating hook complete 10 is disposed under every throat plate 4 within the table 3 as shown in FIGS. 4 and 9. The sewing heads 6 and the rotating hook completes of the same number as that of the throat plates 4 are arranged at intervals corresponding to those of the throat plates 4.

Figure 14:
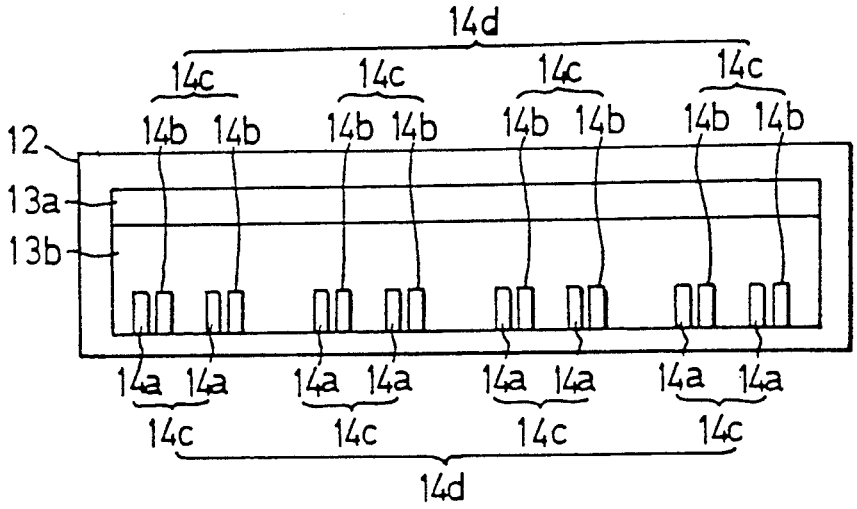
FIG. 14 is a view for explaining the state of the arranged strap holders.

The fabric holding frame 2 is now explained. In FIGS. 1 and 3, the fabric holding frame 2 consists of a bed plate 12 and a presser frame 13 connected to the bed plate 12 for vertical movement. The bed plate 12 is formed with the top surface thereof formed as a support surface to put the fabric A thereon. The presser frame 13 is formed with the bottom surface thereof formed as a presser surface to press the fabric A. The presser frame 13 consists of a main body 13*a* and a movable portion 13*b* connected to the main body 13*a* for horizontal movement. The movable portion 13*b* is provided with a number of strap holders 14*a* and 14*b*. The arrangement of these strap holders 14*a* and 14*b* is shown in FIG. 14. One strap holder 14*a* and one strap holder 14*b* are arranged side by side in the direction of the horizontal movement of the movable portion 13*b* for every needle drop point. The relationship among the many strap holders 14*a* and 14*b* is as follows. Two strap holders 14*a* and 14*a* (or two strap holders 14*b* and 14*b*) for holding the both end portions of one strap make a pair. This pair is represented by a reference numeral 14*c*. In the case of the present embodiment, four straps are necessary for one intermediate bulk container and so four pairs 14*c* make in turn a pair. This new pair is represented by a reference numeral 14*d*. In the case of the present embodiment, two pairs 14*d* are prepared in order that all the straps necessary for producing two intermediate bulk containers can be held. The spacings among either the plural strap holders 14*a*, 14*a* and so on or the plural strap holders 14*b*, 14*b* and so on in each pair 14*d* or 14*d* coincides with the spacings among the aforementioned many throat plates.

Figure 5:
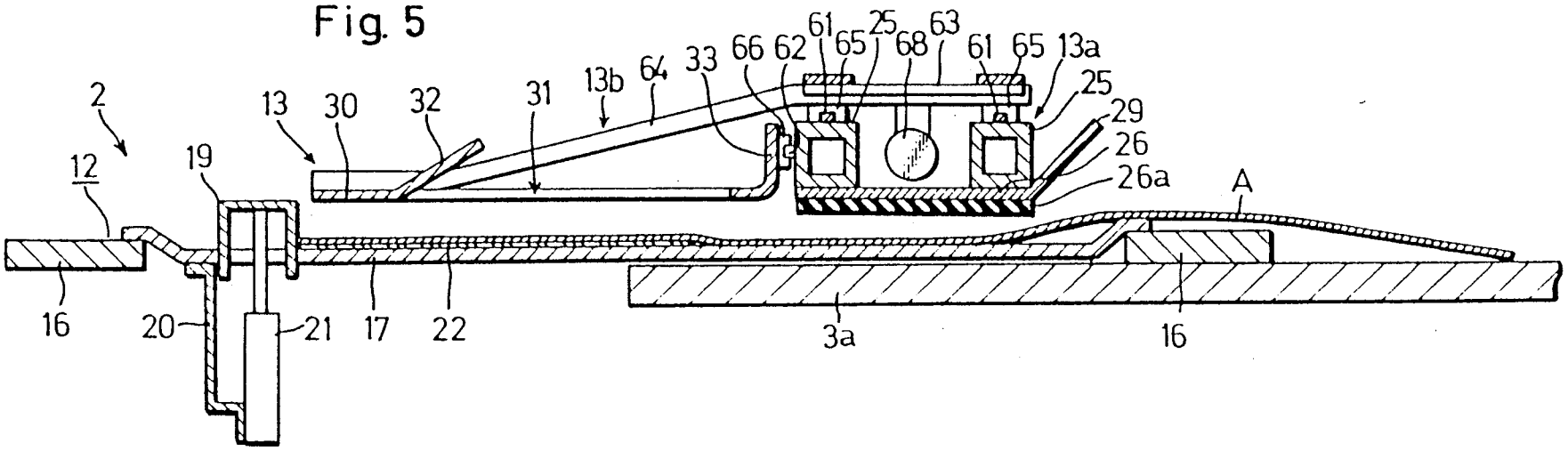
FIG. 5 is a section taken along a line V—V in FIG. 2 with the fabric not yet pressed.
Figure 6:
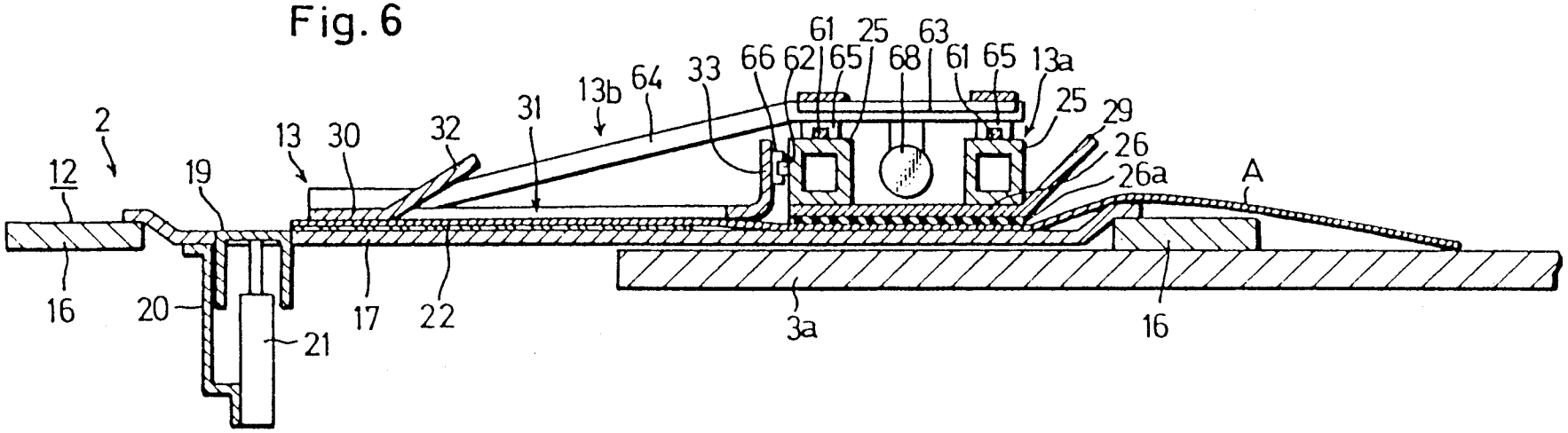
FIG. 6 is a section taken similarly as FIG. 5 but with the fabric pressed.

The aforementioned bed plate 12 is now explained in details. As shown in FIG. 3, the bed plate 12 includes a movable frame 16 and a support plate 17 attached thereon. The movable frame 16 is one known as an embroidering frame in an embroidery machine. The movable frame 16 is put on the top plate 3*a*. The movable frame, being put on the top plate 3*a*, is connected to a drive mechanism provided within the table 3 and is moved horizontally along the top surface of the table 3. Namely, the movable frame 16 is moved in the front and back direction shown by an arrow Y (the lower side being referred to as the front side and the upper side the back side in FIG. 2) and the left and right direction shown by an arrow X in FIGS. 1, 2 and 3. The movable frame 16 is adapted to be connected to or disconnected from the aforementioned drive mechanism freely. As shown in FIGS. 5 and 6, the support plate 17 is secured, at the edge portion thereof, to the movable frame 16 and is depressed at the intermediate portion thereof so as to draw near to the top plate 3*a*. As shown in FIG. 3, the support plate 17 is formed with through openings 18 at positions corresponding to the respective plural throat plates 4. Each through opening 18 is formed to be of such a size that both the two strap holders 14*a* and 14*b* provided side by side on the movable portion 13*b* can face the through opening 18 even when the movable portion 13*b* is moved either to the left or the right with respect to the main body 13*a*. The through opening 18 is covered, over the right and left about one thirds thereof except the central portion thereof, with bearing plates 22 secured on the support plate 17 and the part of the through opening 18 between the bearing plates 22 forms a window 18*a* to expose the needle drop point therethrough. The window 18*a* is adjusted to be of such a sufficient size that the needle drop point can be always exposed even when the bed plate 12 is moved to any of the front, back, left and right sides. The bearing plates 22 are made of a flexible material such as a synthetic resin sheet. The function of these bearing plates 22 is described hereinafter. The bed plate 12 is provided with a positioning means to locate the fabric A to be put on the bed plate 12. Namely, stoppers 19 to locate the fabric in the front and back direction are provided for upward movement beyond and downward movement away from the top surface of the support plate 17 as shown in FIGS. 5 and 6. This stopper 19 is secured on a piston rod of a cylinder 21 disposed, by means of a mount frame 20, under the support plate 17. Moreover, as shown in FIGS. 1 through 3, a positioning mark 88 used for locating the fabric A in the left and right direction is put on the support plate 17. The means for putting the mark is, for example, printing. Stamping and painting may be used as other means.

Next the presser plate 13 is explained. The main body 13*a* in FIGS. 1 through 3 is made of a horizontal frame 25 and a presser plate 26 attached thereunder as shown in these figures and in FIGS. 5 and 6. An antislipping member 26*a* is pasted on the bottom surface of the presser plate 26. The antislipping member 26*a* is made of such a material causing large friction with the fabric A as a rubber sheet. The bottom surface of this antislipping member 26*a* is adapted to function as a fabric pressing surface in the main body 13*a*. A guide piece 29 to introduce the fabric into under the pressing surface is formed integral with the presser plate 26.

Next, as shown in FIGS. 1 through 3 and FIGS. 5 and 6, the movable portion 13*b* has a presser plate 30. The bottom surface of this presser plate 30 is adapted to function as a fabric pressing surface in the movable portion 13*b*. The presser plate 30 are formed with a number of windows 31. These windows are provided so that the introduction of the fabric A under the presser plate 30 is confirmed and the fabric, being introduced, is manually treated. A guide piece 32 to guide the introduced fabric A is provided at the front side edge of the window 31.

Next the structure to connect the movable portion 13*b* to the main body 13*a* is explained. The horizontal frame 25 of the main body 13*a* is provided with many rails 61 and 62. On the other hand, the movable portion 13*b* has a slide frame 63. The slide frame 63 and the presser plate 30 are connected by a connection arm 64. A slide unit 65 is mounted on the bottom surface of the slide frame 63 and another slide unit 66 on the rear surface of an upright piece 33 formed at the rear end of the presser plate 30. The slide units 65 and 66 are engaged with the rails 61 and 62 respectively for slide movement on the respective rails.

Between the main body 13*a* and the movable portion 13*b* is provided a shift mechanism 67 as shown in FIG. 3 which is adapted to move the movable portion 13*b* relative to the main body 13*a* in the horizontal left and right direction. An air cylinder 68 for horizontal drive is provided within the horizontal frame 25 by means of a bracket 69. A piston rod 70 of the cylinder 68 is connected to a bracket 71 secured on the slide frame 63.

Next, the main body 13*a* of the aforementioned presser frame 13 is connected, for vertical movement, to the bed plate 12. The concerned structure is explained. As shown in FIGS. 1 and 3, a cylinder 28 for vertical driving is mounted on the movable frame 16 of the bed plate 12. On the other hand, a connection piece 27 is mounted on the horizontal frame 25 of the main body 13*a*. The connection piece 27 is connected to a piston rod 28*a* of the cylinder 28 by means of screws 27*a*.

Figure 7:
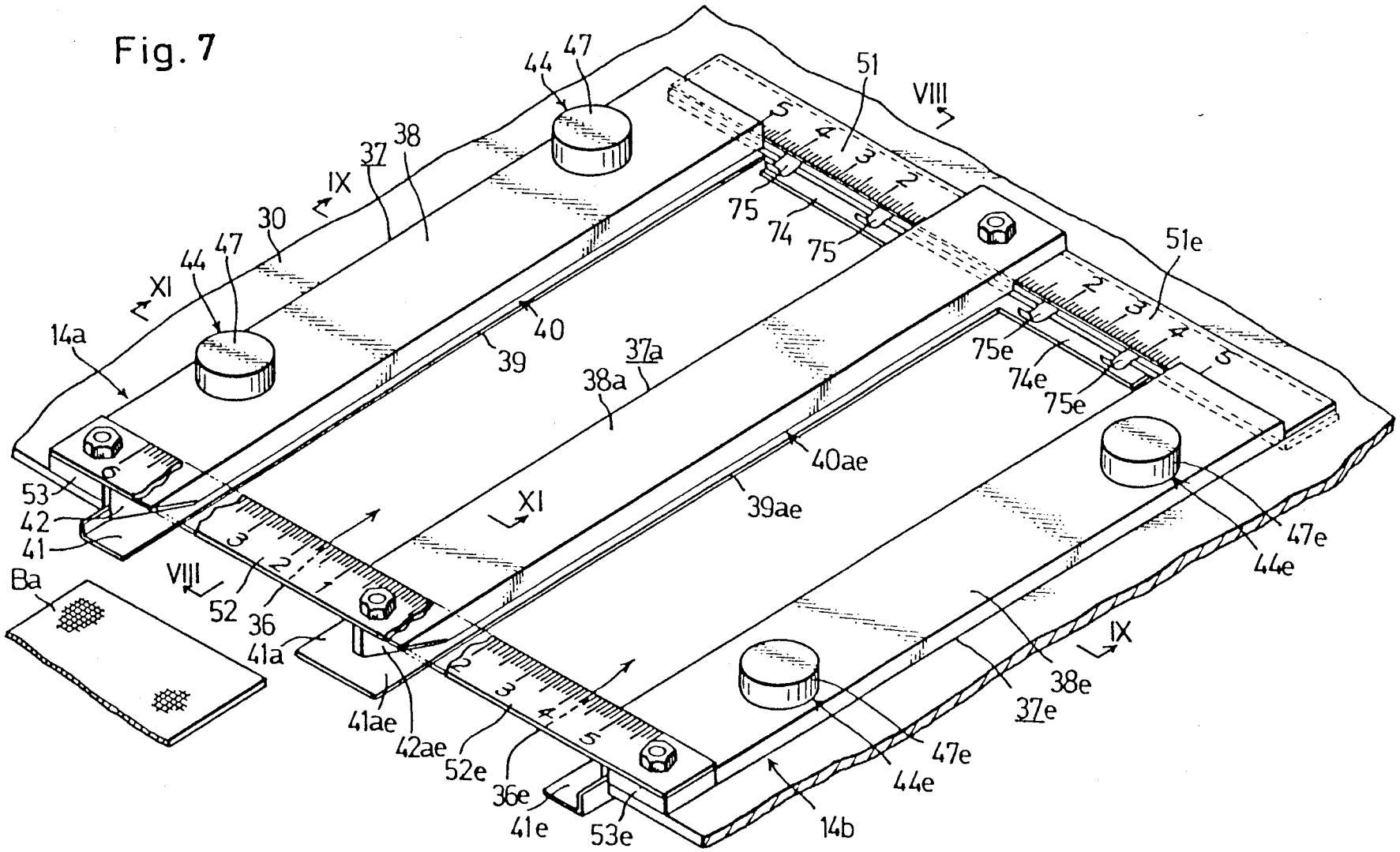
FIG. 7 is a perspective view of strap holders.
Figure 8:
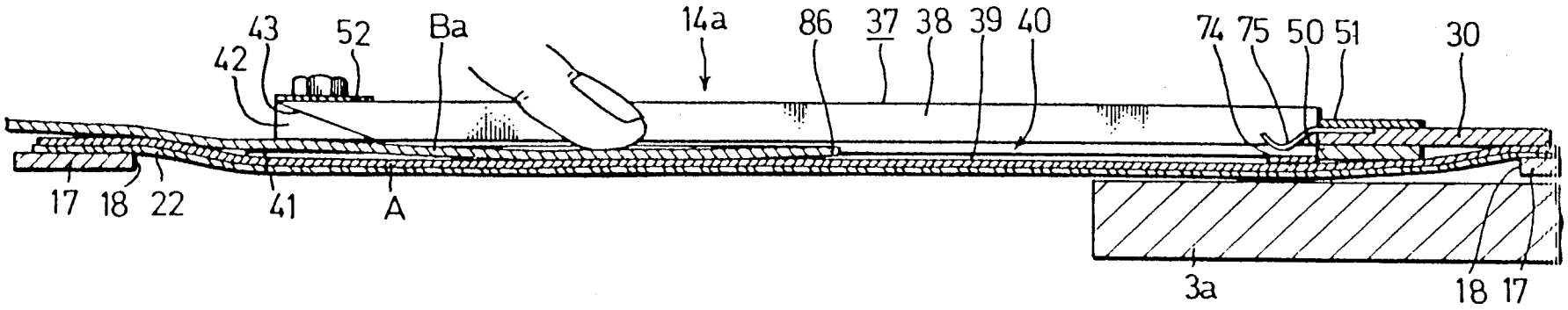
FIG. 8 is a section taken along a line VIII—VIII in FIG. 7.

The aforementioned strap holders 14*a* and 14*b* are now explained in reference with FIGS. 7 through 11. Since the strap holders 14*a* and 14*b* are symmetrically constructed, only the former is explained. The members in the latter corresponding to those in the former are given reference numerals same as those given to the corresponding members in the former but with an appended alphabet "e" and repeated explanation is omitted. The presser plate 30 is formed with a cut region 36. The cut region 36 is formed so as to be open towards the front side of the presser plate 30. The cut region 36 is formed to be of such a sufficient size that the needle drop point can be exposed through the region 36 even when the fabric holding frame 2 is moved in front, back, left and right directions at the time of the sewing work described hereinafter. A pair of left and right hold members 37 and 37*a* are provided on the left and right edge portions of the cut region 36. Each hold member 37 (37*a*) consists of a base member 38 (38*a*) and a support member 39 (39*a*) attached thereto and is formed with a hold groove 40 (40*a*) to insert the edge portion of the strap therein. As shown in FIG. 9, the bottom surfaces of the support members 39 and 39*a* extend downwards beyond the bottom surface of the presser plate 30. The function of these bottom surfaces of the support members 39 and 39*a* is explained hereinafter. As shown in FIGS. 7 and 8, introducing pieces 41 and 41*a* formed integral with the support members 39 and 39*a* respectively are provided so as to extend beyond the open sides of the hold grooves 40 and 40*a*. Moreover, the base member 38 is formed with a guide surfaces 42 and 43 at the entrance side of the hold groove 40. The base member 38*a* is formed as well with similar guide surfaces though not shown. These introducing piece 41 and guide surfaces 42 and 43 are adapted to guide the edge portion of the strap towards the hold groove 40.

Figure 11B:
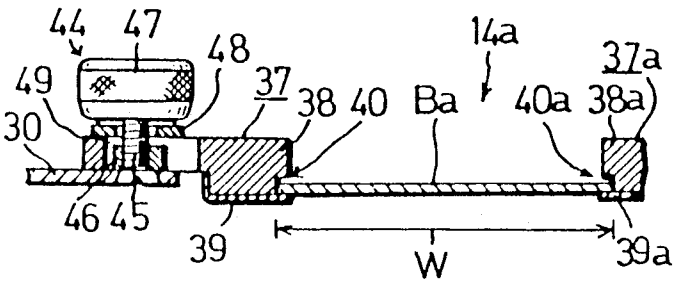
FIG. 11B is a section similar to FIG. 11A showing the state where the spacing between holding grooves in the strap holder is decreased.
Figure 11A:
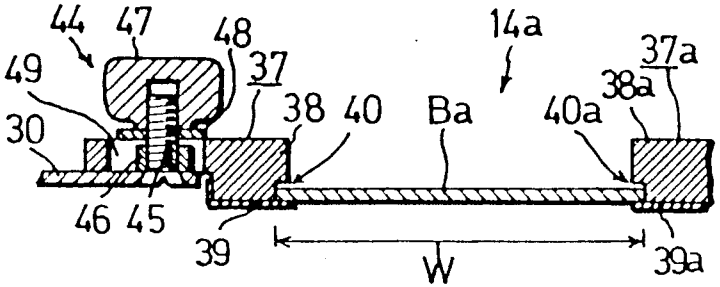
FIG. 11A is a section taken along a line XI—XI in FIG. 7, with the straps loaded.

The spacing between the hold members 37 and 37*a* in the strap holder 14*a* is adjustable in accordance with the width of the strap B. The concerned structure is explained in what follows. The hold member 37*a* is fixed on the presser plate 30. On the other hand, the hold member 37 is attached to the presser plate 30 by means of clamping fixtures 44 which can tightened or loosened. The fixtures 44 are constructed as shown in FIGS. 11A and 11B. Namely, a threaded bar 45 is secured to the presser plate 30 by means of a nut 46. The base member 38 in the hold member 37 is formed with an elongate hole 49 along the left and right direction in FIGS. 11A and 11B. The threaded bar 45 is inserted through this elongate hole 49 and is in thread engagement, via a washer 48, with a fastening member (nut) 47. With such a structure, the spacing W between the left and right hold grooves 40 and 40*a* can be adjusted in accordance with the width of the end portions Ba of the strap B by loosening the fixture 44 to change the position of the hold member 37 to the left or the right as shown in FIGS. 11A and 11B. The strap holder 14*a* is provided with a structure to find the spacing W. Namely, as shown in FIG. 7, the strap holder is provided with a pair of front and back gauges 52 and 51. The gauge 51 is mounted on the presser plate 30. The gauge 52 is mounted, at one end thereof, on a mount 53 secured on the presser plate 30 and, at the other end thereof, on the base member 38*a* of the hold member 37*a*.

The strap holder 14*a* includes a structure to prevent the end portion Ba of the strap B loaded therein from coming off. The structure is explained. A stopper 50 is attached to the bottom surface of the presser plate 30 at the most interior position in the cut region 36 as shown in FIG. 8. The stopper 50 is adapted to determine the insertion depth of the end portion Ba of the strap B. The stopper 50 is provided, at the front side thereof, with a support piece 74 and a clamp piece 75. The support piece 74 is formed integral with the support member 39*a*. The clamp piece 75 is made of a spring material and is secured at the presser plate 30. These support piece 74 and clamp piece 75 are adapted to clamp therebetween the tip of the end portion Ba of the strap B inserted into the strap holder 14*a* and to prevent the end portion Ba from coming off from the strap holder 14*a*.

Now the loading of the fabric A and the strap B with use of the above mentioned fabric holding frame 2 is explained.

Figure 13A:
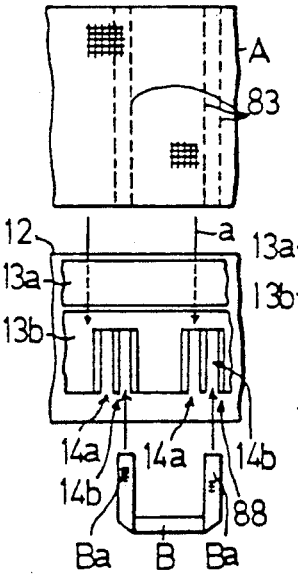
FIGS. 13A through 13D are plane views showing work procedures.

The fabric A is loaded as follows. First the presser frame 13 is kept raised as shown in FIG. 4. With the frame 13 kept raised, the fabric A is introduced from the back side of the sewing machine onto the bed plate 12 as shown by an arrow "a" and a state as shown in FIG. 5 results. The fabric A is introduced by such a distance that the front end of the fabric A abuts on the stopper 19. Thus the fabric A has been located in the front and back direction relative to the bed plate 12. The fabric A is located in the left and right direction in the following manner. As shown in FIG. 13A, a number of marks 83 showing the position to sew the end portion Ba of the strap B thereon are put on the fabric A. This mark is made beforehand by weaving yarns of a different color when the fabric is woven. The fabric A is located in the left and right direction in such a manner that the right end one of these marks 83 coincides with the positioning mark 88 on the bed plate 12. When the fabric A is introduced in the above mentioned manner, the front end of the fabric A can be smoothly guided by the guide pieces 29 and 32 into under the presser frame 13 even if the presser frame 13 is raised to a relatively low position or if the front end of the fabric A is wavy. When the introduced fabric A is wrinkled, it is smoothed by a hand inserted through the window 31.

After the fabric A has been introduced in the above mentioned manner, the presser frame 13 is next lowered by the cylinder 28. Thus the presser frame 13 presses the fabric A onto the bed plate 12 over almost all the region except the window 31 and the cut regions 36 and 36*e* in the strap holders 14*a* and 14*b* respectively. In this case, the main body 13*a* of the presser frame 13, in particular, presses firmly the fabric A onto the support plate 17 of the bed plate 12. As a result, the fabric A is completely prevented from moving horizontally. Moreover, the bottom surfaces of the support members 39, 39*a* and 39*e* in the strap holders 14*a* and 14*b* push the fabric A downwards, through the through opening 18 beyond the top surface of the support plate 17 as shown in FIG. 9. In this case, the bearing plate 22 is bent by the pushing support members. Since the fabric A is pushed downwards in the above mentioned manner, such part of the fabric A as facing the window 18*a* becomes pushed against a bulged portion 4*a* of the throat plate 4*b* as shown in FIG. 9. The fabric A pushed down in this manner is prevented from moving vertically against the bulged portion 4*b*. As a result, the fabric can be sewn correctly.

Figure 10:
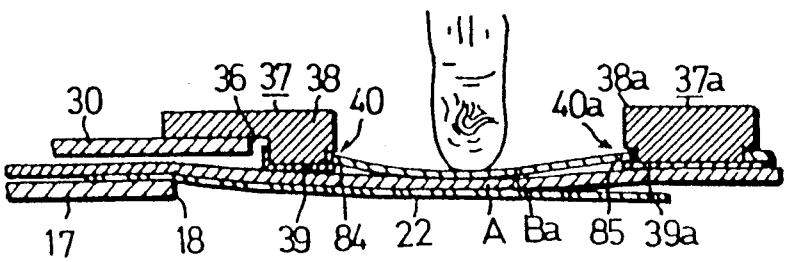
FIG. 10 is a section showing the state where the end portion of the strap is trusted by the tip of a finger.

On the other hand, the strap B is loaded in the following manner. The intermediate portion of the strap B is twisted as shown in FIG. 3. Next, the end portion Ba of the strap B is loaded into the strap holder 14*a* or 14*b* from the front side of the multi-head sewing machine 1 as shown by an arrow "b" in FIG. 4. In this case, the both side edge portions 84 and 85 of the end portion Ba are inserted along the hold grooves 40 and 40*a* as shown in FIG. 9. When the end portion Ba, being inserted, becomes hard to advance, it is advisable to thrust the end portion Ba by the tip of a finger attached thereto as shown in FIG. 8 or 10. In this case, the bearing plate 22 located under the end portion Ba prevents the end portion Ba from being excessively bent even if the force to push the end portion downwards is somewhat too large. As a result, the both side edge portions 84 and 85 of the end portion Ba are prevented from becoming off from the hold grooves 40 and 40*a*. The end portion Ba is continuously inserted until the front end 86 of the end portion Ba abuts on the stopper 50. When the end portion Ba has been fully inserted, the front end 86 of the end portion Ba is clamped between the support piece 74 and the clamp piece 75. As a result, the end portion Ba is prevented from easily coming off from the strap holder 14*a*. The above mentioned operation is performed for each pair of one and the other end portions Ba and Ba of all the straps B to be sewn on one fabric A. In this condition, the twisting direction of the intermediate portion of each strap B should be inspected.

As a result of the above mentioned loading of the fabric A and the straps B, a state results where the end portions Ba of a number of straps are attached to and located correctly on the fabric A at prescribed positions where respective straps B are to be sewn.

Figure 12:
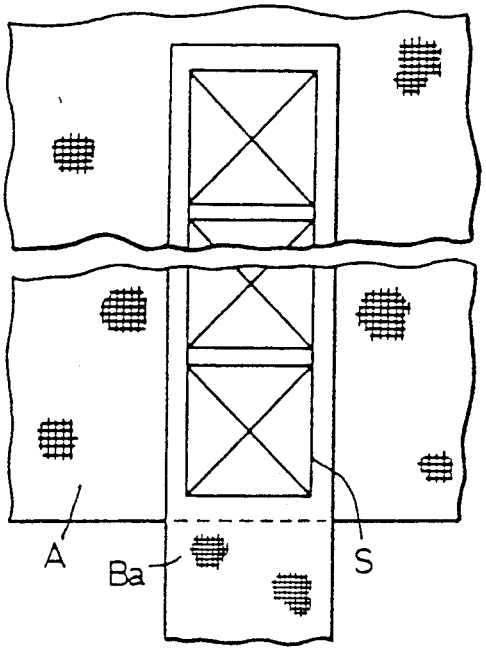
FIG. 12 is a view showing the state of the end portions of the straps sewn on the fabric.
Figure 15:
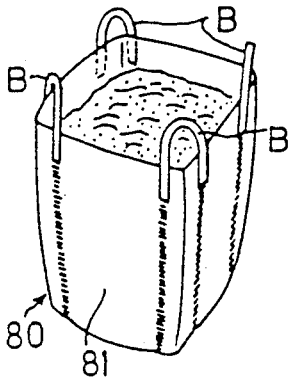
FIG. 15 is a perspective view of an intermediate bulk container.
Figure 16:
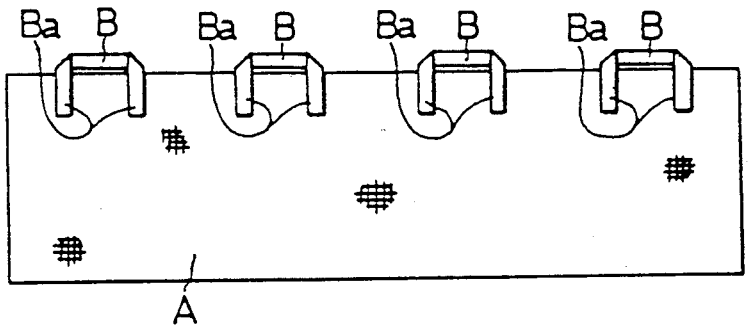
FIG. 16 is a view showing the fabric with respective both end portions of the plural straps attached thereon.
Figure 17A:
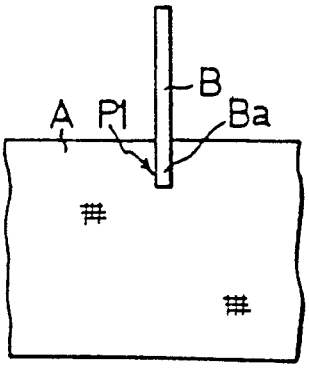
Fig. 17A Prior Art
FIGS. 17A and 17B are views for explaining the conventional method of sewing straps.
Figure 17B:
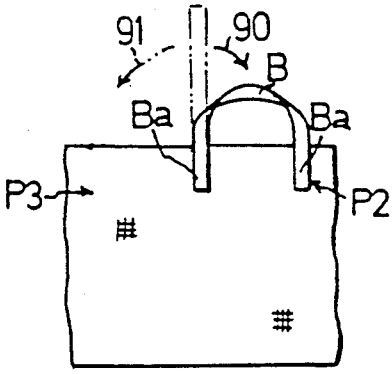
Fig. 17B Prior Art

Next, the work to sew the end portion Ba of the strap B on the fabric A is explained. After the fabric A and the plural straps B have been loaded, the multi-head sewing machine is started. Each rotating hook 10 is then rotated and each sewing needle 7 is vertically reciprocated. Moreover, the fabric holding frame 2 is moved in the directions shown by the arrows X and Y by the driving mechanism within the table 3 and the fabric A and the many straps B are as well moved together. As a result, each end portion Ba of every strap B is sewn on the fabric A at a seam S as shown, for example, in FIG. 12. In this case, the movement of the fabric holding frame 2 is controlled in a manner similar to that of a well known embroidery machine. As a result of the above mentioned sewing work, the both end portions Ba of the plural straps B have been completely sewn on the fabric A as shown in FIG. 16.

In the next place, a method of sewing many straps one after another on a number of fabrics A is one in which only one of the two strap holders 14*a* and 14*b* arranged side by side on the respective portions of the presser frame 13, for example, only the strap holder 14*a* is always used for sewing the end portion Ba of the strap B held herein in the above mentioned manner. The other method is as follows. The procedure of this method is explained in reference with FIGS. 13A through 13D.

At the beginning of the sewing work, the fabric A in the state as shown in FIG. 13A is introduced onto the bed plate 12 as shown by the arrow "a", In this case, the fabric A is located in the left and right direction by making the right end mark 83 coincide with the positioning mark 88 of the bed plate 12. On the other hand, the end portion Ba of each strap B is held by the strap holder 14*b*. In this state, the presser frame 13 is lowered to fix the fabric A in the above mentioned manner. In this state, the strap holder 14*b* is at a position where it faces the window 18*a*.

Figure 13B:
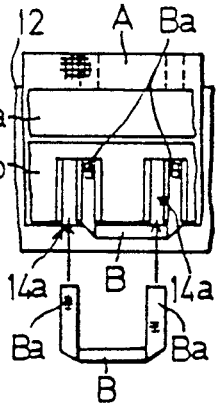

Next, the end portions Ba are sewn on the fabric A as shown in FIG. 13B. While the end portions Ba are being sewn, the end portions Ba of the plural straps to be sewn on the next fabric are loaded in the unoccupied strap holder 14*a*.

Figure 13C:
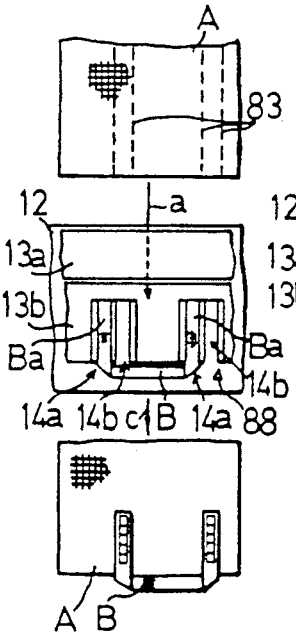

Next, after the above mentioned sewing work has been completed, the presser frame 13 is raised and then the fabric A with the strap B sewn together thereto is pulled out forwards as shown by an arrow "c" in FIG. 13C. Then the next fabric A is introduced onto the bed plate 12 from the back side thereof as shown by the arrow "a". Also in this case, the fabric A is located in the left and right direction by making the right end mark 83 coincide with the mark 83. Next the movable portion 13*b* is shifted horizontally (in this case, to the right) relative to the main body 13*a* by a distance corresponding to the spacing between the strap holders 14*a* and 14*b* by the aforementioned drive mechanism 67. Thus the strap holder 14*a* comes to a position where it faces the window 18*a* and the end portions Ba of the strap B are brought to positions over the prescribed sewing positions on the fabric A. In this state, the presser frame 13 is lowered to fix the fabric A.

Figure 13D:
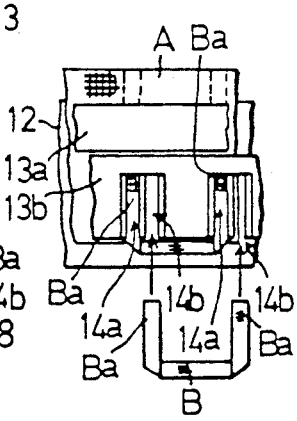

Next, the end portions Ba held in the strap holder 14*a* are sewn on the fabric A newly introduced in the above mentioned manner as shown in FIG. 13D. While these end portions are being sewn, the end portions Ba of a strap to be sewn at the next time are held in the unoccupied strap holder 14*b*.

Further in the same manner as described above, taking out of the fabric A with the straps having been sewn together thereto, loading a new fabric A, selectively positioning one of the two straps holders 14*a* and 14*b*, arranged side by side, relative to the window 18*a* by horizontally driving the movable portion 13*b*, sewing the straps B on the new fabric A and loading the straps B for the next fabric in the unoccupied strap holders are repeated one after another.

The fabric A may be located in the left and right direction also by bringing the mark 83 to a position overlapping the unoccupied strap holder.

When the respective plural straps are sewn on many fabrics A one after another in the above mentioned procedure, there is the following usefulness. The times required for the above mentioned various works are roughly, for example, 10 seconds for loading the fabric A, 20 seconds for loading the straps B, 30 seconds for sewing and 3 seconds for taking out the fabric A with completely sewn straps B. The sum of all these times is 63 seconds. In the above mentioned procedure, however, it takes, in effect, 43 seconds to sew four straps B on one fabric A since the straps B for the next fabric are loaded while the sewing work is being done. This fact brings about 50% increase in products per unit time.

The aforementioned objects are attained according to the present invention as described above and there are an effect that the end portions of the plural straps can be sewn on the fabric A with very high work efficiency, an effect that the detection and the correction of the mistake in selecting the twist direction of the plural straps can be performed very easily and further an effect that homogeneous products can be provided when the respective plural straps are sewn on many fabrics.

As many apparently widely different embodiments of this invention may be made without departing from the spirit and scope thereof, it is to be understood that the invention is not limited to the specific embodiments thereof except as defined in the appended claims.

What is claimed is:

1. A fabric holding frame for a sewing machine comprising:

(a) a bed plate adapted to be mounted for horizontal movement on a table of a multi-head sewing machine and having a top surface to put a fabric thereon, and (b) a presser frame connected to said bed plate for vertical movement relative to said bed plate and having a bottom surface thereof to press down said fabric, said bed plate including:

(i) a positioning means to locate said fabric to be put thereon and (ii) plural windows formed of a sufficient size so that each needle drop point on the table of said multi-head sewing machine can be exposed always through a respective one of said windows, said presser frame having strap holders for holding straps, each strap holder being located at a position facing a respective one of said windows, and each strap holder including a cut region of a sufficient size always to expose each respective needle drop point and hold members which are formed at the side edge portions of said cut region in order to hold side edges at the end portion of each of said straps.

2. A fabric holding frame for a sewing machine as set forth in claim 1 wherein said presser frame consists of a main body and a movable portion, said main body being connected to said bed plate for vertical movement relative to said bed plate and said movable portion being connected to said main body for horizontal movement relative to said main body and every two of said strap holders are arranged in the direction of the horizontal movement of said movable frame in such a manner that a selected one of said every two strap holders can be brought to a position where said selected one strap holder faces said window.

3. A fabric holding frame for a sewing machine as set forth in claim 1 wherein bottom surfaces of said hold members extend downwards beyond bottom surfaces of a circumferential portion thereof.

4. A fabric holding frame for a sewing machine as set forth in claim 2 wherein bottom surfaces of said hold members extend downwards beyond bottom surfaces of a circumferential portion thereof.

5. A fabric holding frame for a sewing machine as set forth in claim 4 wherein said bed plate is formed with through openings at positions corresponding to said each needle drop point, said each through opening is covered, except the central portion thereof, with bearing plates made of a flexible material, and said central portion between the bearing plates forms said window.

* * * * *